United States Patent [19]

Sharp

[11] Patent Number: 4,842,070

[45] Date of Patent: Jun. 27, 1989

[54] PROCEDURE FOR IMPROVING RESERVOIR SWEEP EFFICIENCY USING PARAFFINIC OR ASPHALTIC HYDROCARBONS

[75] Inventor: Kenneth A. Sharp, Sedalia, Colo.

[73] Assignee: Amoco Corporation, Chicago, Ill.

[21] Appl. No.: 244,967

[22] Filed: Sep. 15, 1988

[51] Int. Cl.[4] ..... E21B 33/134; E21B 43/24; E21B 37/00

[52] U.S. Cl. ..... 166/288; 166/294; 166/312

[58] Field of Search ..... 166/288, 294, 303, 305.1, 166/312

[56] References Cited

U.S. PATENT DOCUMENTS

| | | | |
|---|---|---|---|
| 1,307,027 | 6/1919 | Swan | 166/288 |
| 1,327,268 | 1/1920 | Christians | 166/288 X |
| 2,753,939 | 7/1956 | Carpenter et al. | 166/303 |
| 2,779,415 | 1/1957 | Howard | 166/288 X |
| 2,799,341 | 7/1957 | Maly | 166/288 |
| 3,003,555 | 10/1961 | Freeman et al. | 166/288 |
| 3,399,623 | 9/1968 | Creed | 166/302 X |
| 4,444,261 | 4/1984 | Islip | 166/288 X |

*Primary Examiner*—George A. Suchfield

*Attorney, Agent, or Firm*—L. Wayne White; Fred E. Hook

[57] ABSTRACT

A method for selectively placing and removing a plugging agent in a formation adjacent a wellbore comprising preheating the wellbore, heating and injecting the plugging agent at a temperature higher than its melting point, shutting in the well to allow the plugging agent in the formation to cool and solidify, reheating the formation adjacent the wellbore, and swabbing back the liquidified plugging agent from the low permeability zones adjacent the wellbore. The expected benefit is reduction of permeability in the high permeability zones without a corresponding loss of permeability in the low permeability zones. The method provides better vertical sweep and improved recovery.

3 Claims, No Drawings

PROCEDURE FOR IMPROVING RESERVOIR SWEEP EFFICIENCY USING PARAFFINIC OR ASPHALTIC HYDROCARBONS

BACKGROUND OF THE INVENTION

1. Field of the Invention

This invention pertains to a method of improving reservoir sweep efficiency in secondary and tertiary oil recovery operations.

2. Description of the Prior Art

In secondary and tertiary operations, the ultimate recovery is strongly affected by the sweep efficiency in the reservoir. Poor vertical sweep results not only in reduced recovery but in higher operating costs due to cycling of injected fluids. Many different procedures have been attempted to improve vertical sweep. A major problem encountered in previous efforts is the problem of selectively placing a plugging agent in so-called thief zones in the formation to divert the flow of treatment fluids to less permeable portions of the formation. This invention is a procedure which can improve the operator's ability to selectively place the plugging agent.

SUMMARY OF THE INVENTION

I have discovered a method for selectively placing and removing a plugging agent in a formation adjacent a wellbore to thereby provide a reduction of permeability in a high permeability zone without a corresponding loss of permeability in a low permeability zone of the formation, said method comprising preheating the wellbore, heating and injecting the plugging agent at a temperature higher than its melting point, shutting in the well to allow the plugging agent in the formation to cool and solidify, reheating the formation adjacent the wellbore, and swabbing back the liquidified plugging agent from the low permeability zones adjacent the wellbore. The expected benefit is a reduction of permeability in the high permeability zone without a corresponding loss of permeability in the low permeability zone.

DETAILED DESCRIPTION OF THE INVENTION

It is known that the speed which an injected fluid propagates away from the wellbore in a given formation layer is related to the rate at which treatment fluids are accepted by the layer, sometimes referred to as the "speed of the layer", (permeability/porosity or $k/\phi$). So when a fluid is injected in a well, the injected fluid will remain closer to the wellbore in the slow layers than it will in faster layers. If a plugging agent is injected into the well which has a highly temperature dependent viscosity, it can be removed from the near wellbore region by heating the wellbore and swabbing the well. On the basis of this inventive concept, for a properly designed workover, all the plugging agent that entered the slow layers can be recovered since the material would be in the reheated region of the formation adjacent the wellbore. On the other hand, plugging agent in the fast layers would remain in the formation since it is displaced beyond the reheated region.

Selecting a plugging agent on the basis of its thermal properties has several advantages: first, an effective plug of layers with high permeability to porosity ratios ($k/\phi$) or natural fractures can be obtained (their existence usually results in poor vertical sweep); second, the plugging agent can be removed from zones of low $k/\phi$; and third, since the plugging agent does not penetrate far from the wellbore, if undesirable effects are obtained, the wellbore can be restored to near preworkover conditions by the application of a small fracture stimulation.

Optimally, the plugging agent would require sufficient viscosity at reservoir temperatures to be immobile or essentially immobile; however, with a moderate elevation in temperature, the plugging agent must become mobile. Some compounds which can be used as plugging agents include paraffins, tars, wax, and other such hydrocarbons. The viscosity temperature relationship of these compounds can be controlled to some degree during manufacturing and a wide range of compounds are commercially available with a range of melting points.

The following procedure can be used to selectively place and remove the plugging agent. The first step would be to preheat the wellbore by injecting hot water, steam, or hot oil into the wellbore and into contact with the formation. The reservoir will be heated by a combination of conduction and convection associated with the mass transfer of the injected fluid. Since most of the injected fluid will enter the zone(s) of high $k/\phi$ or fractures, these intervals will be preheated further away from the wellbore than low $k/\phi$ intervals. This effect can be further enhanced by using mechanical separation in the wellbore, e.g., mechanical plugs to focus the injected fluid onto a particular layer or zone of the formation.

After the wellbore has been preheated, the plugging agent is heated above its melting point and injected. As the plugging agent moves out of the preheated area of the formation, it begins to cool and solidify. The distance away from the wellbore that the plugging agent moves in a layer is related to the $k/\phi$ of that layer. The wellbore is then shut in and the wellbore allowed to cool.

Once the plugging agent has "solidified," the wellbore is again heated by cycling hot water, steam, or hot oil within the wellbore. One important difference between reheating the well and preheating is that heating is done primarily by conduction; this is true because there is little if any fluid entry into the formation. Therefore, all layers would be heated above the melting point of the plugging agent to approximately the same distance from the well. Since the plugging agent was displaced to different distances in the formation, it is possible to melt all of the plugging agent in the slow zones while only melting that near the well in the fast or high $k/\phi$ zones by heating for the correct period of time. The mobile plugging agent is swabbed back into the wellbore. An alternative method of removal would be to swab the well and heat the wellbore mechanically in an underbalanced condition to force the mobile plugging agent to flow back. Since a portion of the plugging agent remains highly viscous in the fast layers or fractures, most of the plugging agent will remain in the formation and will not be recovered from the fast layers.

Additional cleanup of the slow intervals can then be accomplished by washing the well with a suitable solvent. Since the solvent could potentially remove all remaining traces of the plugging agent by dissolution, the injectivity or productivity of the slow intervals can be restored to preworkover values. Solvent would not enter the fast or high $k/\phi$ zones due to the viscous plug.

Many compounds exist which can be used as plugging agents for this procedure. Paraffinic and asphaltic hydrocarbons are currently preferred and paraffinic hydrocarbons are most preferred based on economics and commercial availability, but other "waxy" hydrocarbons and inert organic salts which have appropriate melting points (or ranges) can be used. By "inert" is meant unreactive with the formation.

What is claimed is:

1. A method for selectively placing and removing a plugging agent in a formation adjacent a wellbore to thereby provide a reduction of permeability in a high permeability zone without a corresponding loss of permeability in a low permeability zone of the formation, said method comprising preheating the wellbore using steam or hot oil, heating and injecting the plugging agent at a temperature higher than its melting point, shutting in the well to allow the plugging agent in the formation to cool and solidify, reheating the formation adjacent the wellbore, and swabbing back the liquified plugging agent from the low permeability zones adjacent the wellbore.

2. The method defined by claim 1 wherein said plugging agent is a paraffinic hydrocarbon.

3. The method defined by claim 1 wherein the well is subsequently washed with a suitable solvent to remove the plugging agent from the wellbore by injecting the solvent into the wellbore and into contact with the formation and then removing the spent solvent from the wellbore.

* * * * *